US009060572B2

(12) United States Patent
Hasegawa et al.

(10) Patent No.: US 9,060,572 B2
(45) Date of Patent: Jun. 23, 2015

(54) BUTTON FIXING MEMBER AND BUTTON STRUCTURE

(75) Inventors: Kenji Hasegawa, Tokyo (JP); Makoto Momose, Tokyo (JP); Hiroyuki Sugiyama, Tokyo (JP)

(73) Assignee: YKK Corporation (JP)

( * ) Notice: Subject to any disclaimer, the term of this patent is extended or adjusted under 35 U.S.C. 154(b) by 268 days.

(21) Appl. No.: 13/812,169

(22) PCT Filed: Jul. 26, 2010

(86) PCT No.: PCT/JP2010/062555

§ 371 (c)(1),
(2), (4) Date: Jan. 25, 2013

(87) PCT Pub. No.: WO2012/014274

PCT Pub. Date: Feb. 2, 2012

(65) Prior Publication Data

US 2013/0117972 A1 May 16, 2013

(51) Int. Cl.

| | |
|---|---|
| ***A44B 1/06*** | (2006.01) |
| ***A44B 1/08*** | (2006.01) |
| ***A44B 1/42*** | (2006.01) |

(Continued)

(52) U.S. Cl.

CPC ..... *A44B 1/06* (2013.01); *Y10T 24/45042* (2015.01); *Y10T 24/3613* (2015.01); *Y10T 24/3615* (2015.01); *Y10T 24/3611* (2015.01); *Y10T 24/45916* (2015.01); *Y10T 24/4556* (2015.01); *A44B 1/42* (2013.01); *A44B 17/0035* (2013.01);

(Continued)

(58) Field of Classification Search

CPC .. A44B 17/0035; A44B 17/0041; A44B 1/06; A44B 1/08; A44B 1/185; A44B 1/42

USPC ..... 24/94, 95, 96, 621, 689, 578.11

See application file for complete search history.

(56) References Cited

U.S. PATENT DOCUMENTS 3,195,201 A * 7/1965 Ash, II ..... 24/689
3,349,451 A 10/1967 Maeno (Continued)

FOREIGN PATENT DOCUMENTS

EP 144777 6/1985
EP 891723 A2 * 1/1999 ..... A44B 17/00

(Continued)

OTHER PUBLICATIONS

International Search Report and Written Opinion, PCT International Application No. PCT/JP2010/062555, mailed Oct. 26, 2010.

*Primary Examiner* — Robert J Sandy
(74) *Attorney, Agent, or Firm* — Kilpatrick Townsend & Stockton LLP

(57) ABSTRACT

A button fixing member made of synthetic resin, used to fix a button having a fixing opening to a cloth, the button fixing member including a plate-like base and a post protruding from the base to a front surface side of the base. The post is deformed after it passes through the cloth and the fixing opening of the button when the button is fixed to the cloth. The post includes a cavity extending from an opening on a rear surface of the base to a closed end on the tip side of the post concentrically with the post, and a solid portion between the closed end of the cavity and the tip of the post. The axial length of the solid portion is set to be ⅕ or more of the length of the part of the post from the front surface of the base to the tip of the post.

5 Claims, 8 Drawing Sheets

(51) Int. Cl.
*A44B 17/00* (2006.01)
*A44B 1/18* (2006.01)

(52) U.S. Cl.
CPC . *A44B 1/08* (2013.01); *A44B 1/185* (2013.01); *A44B 17/0041* (2013.01)

(56) References Cited

U.S. PATENT DOCUMENTS

| | | | | |
|---|---|---|---|---|
| 4,539,735 | A * | 9/1985 | Kasai | 24/621 |
| 4,562,624 | A * | 1/1986 | Kanzaka | 24/621 |
| 4,607,415 | A | 8/1986 | Fukuroi | |
| 4,751,771 | A * | 6/1988 | Watanabe | 24/95 |
| 5,933,929 | A | 8/1999 | Kawakami et al. | |
| 6,457,213 | B2 * | 10/2002 | Watanabe | 24/94 |

FOREIGN PATENT DOCUMENTS

| | | | |
|---|---|---|---|
| GB | 1073355 | | 6/1967 |
| GB | 2149647 | | 6/1985 |
| JP | 50-65344 | A | 6/1975 |
| JP | 83406/1985 | | 6/1985 |
| JP | 167127/1988 | | 10/1988 |
| JP | 7-289311 | A | 11/1995 |
| JP | 8-299027 | A | 11/1996 |
| JP | 10-32210 | A | 2/1998 |
| JP | 11-32815 | A | 2/1999 |

* cited by examiner

BUTTON FIXING MEMBER AND BUTTON STRUCTURE

This application is a national stage application of PCT/JP2010/062555 which is incorporated herein by reference.

BACKGROUND OF THE INVENTION

The present invention relates to a button fixing member and a button structure, and more specifically to a button fixing member made of a synthetic resin, which is used to fix, to a cloth, a button such as a female snap, a male snap, a decorative button and the like, and a button structure consisting of such a button fixing member and such a button.

When a button such as a female snap and the like is fixed to a cloth, a button fixing member is generally used, which comprises a disk-like base and a post protruding from the base and tapering. When a button is fixed to a cloth using such a button fixing member, the button attaching member is set on a lower die below the cloth as horizontally placed, and the button is held by an upper die above the cloth. After that, the upper die is lowered. Thereby, the post of the button attaching member pierces the cloth upwardly and then passes through a fixing opening of the button to stick out. By swaging an distal side part of the post by a punch in the upper die, the button is fixed onto the cloth.

The button fixing member made of a synthetic resin is generally produced by injection molding, where a melted thermoplastic resin is injected into a mold and then cooled and solidified therein. The post is required to be thickened to a certain extent (relatively large diameter) in order to obtain strength etc. needed on swaging. However, in injection-molded button fixing members, there is a problem that void (shrinkage cavity) easily arises in a relatively thick post. If a quantity of void arising is relatively large, the post would be broken or a force for fixing a button would not reach the expected value when a button is fixed to a cloth with the button fixing member. In addition, since there are variations in a quantity of void arising, there would be variations in a force for fixing a button. If a material temperature, a mold temperature, a cooling time, etc. are changed at the time of injection-molding so as not to generate void, shrinkage (contraction) will occur on the outer surface of a molded product, or production efficiency will be reduced.

In view of the problems as mentioned above, an object of the present invention is to provide a button fixing member and a button structure in which the post contains almost no void.

SUMMARY OF THE INVENTION

To solve the above-mentioned problems, according to the present invention, there is provided a button fixing member made of a synthetic resin, which is used to fix a button having a fixing opening to a cloth (cloth includes fabric, textile, nonwoven fabric, felt, leather, resin sheets, etc.), the button fixing member comprising: a plate-like base and a post protruding from the base to a front surface-side of the base, the post being deformed after it passes through the cloth and then the fixing opening of the button when the button is fixed to the cloth, wherein the post includes a cavity extending from an opening on a rear surface of the base to a closed end on the tip-side of the post concentrically with the post, and a solid portion between the closed end of the cavity and the tip of the post.

In the invention, since the cavity, one axial end of which is open on the rear surface of the base of the button fixing member and the other axial end of which terminates inside the cavity as a closed end, is formed inside the post concentrically with the post, the thickness of the post can be reduced. Therefore, even if the button fixing member is injection-molded, void would almost not arise inside the post. Further, with the solid portion left on the tip side of the post, it would be possible to secure a quantity of material needed for swaging.

As examples of the synthetic resin making the button fixing member, thermoplastic resin such as polyethylene (PE), polypropylene (PP), polyvinyl chloride (PVC), polystyrene (PS), polyvinyl acetate (PVAc), poly-tetra-fluoro-ethylene (PTFE), ABS resin (acrylonitrile butadiene styrene resin), AS resin, acrylic resin (PMMA) and the like, and thermo-hardening resin such as phenol resin (PF), epoxy resin (EP), melamine resin (MF), urea resin (UF), unsaturated polyester resin (UP), alkyd resin, polyurethane (PUR), thermo-hardening polyimide (PI) and the like can be quoted, but not limited thereto.

In an embodiment of the invention, the length of the solid portion in the longitudinal direction (or the axial direction) of the post is ⅕ or more of the length of the part of the post from the front surface of the base to the tip of the post. In this case, the solid portion in which the cavity does not exist is left on the tip side of the post for the length of ⅕ or more of the entire length of the post in the longitudinal direction. Thereby, it is possible to secure a quantity of material needed for swaging. Also, the length of the cavity in the longitudinal direction of the post is ⅘ or less of the length of the post.

In an embodiment of the invention, the diameter of the cavity is gradually reduced from the opening to the closed end. In this case, in the portion except for the solid portion of the post, it would be possible to obtain more quantity of material for swaging on the tip side of the post. Also, it would be easier to pull out a die from the cavity at the injection-molding process.

In an embodiment of the invention, the post includes a post proximal part rising from the base, the outer diameter of the post proximal part being constant, and a post distal part, the outer diameter of which is gradually reduced from the upper end of the post proximal part to the tip, the post proximal part including the cavity. In this case, the cavity may extend beyond the post proximal part reaching the post distal part.

In an embodiment of the invention, around the opening on the rear surface of the base, there is an annular bulge, which is for closing the opening as the button is fixed to the cloth. When the button is fixed to the cloth, the annular bulge can be crushed by a lower punch or the like so as to close the opening of the cavity, which can improve aesthetic appearance.

According to another aspect of the present invention, there is provided a button structure which consists of a button having a fixing opening and a button fixing member made of a synthetic resin, which is used to fix the button to a cloth, the button fixing member comprising: a plate-like base and a post protruding from the base to a front surface-side of the base, the post being deformed after it passes through the cloth and then the fixing opening of the button when the button is fixed to the cloth, wherein the post includes a cavity extending from an opening on a rear surface of the base to a closed end on the tip-side of the post concentrically with the post, and a solid portion between the closed end of the cavity and the tip of the post. As specific examples of a button, a female snap, a male snap, a decorative button and the like can be quoted.

In the invention, since the cavity, one axial end of which is open on the rear surface of the base of the button fixing member and the other axial end of which terminates inside the cavity as a closed end, is formed inside the post concentrically with the post, the thickness of the post can be reduced. Therefore, even if the button fixing member is injection-molded, void would almost not arise inside the post. Consequently, when a button is fixed to a cloth with the button fixing member, it would be unlikely that the post is broken and a force for fixing a button comes short or varies, due to void.

DETAILED DESCRIPTION OF THE INVENTION

Figure 1:
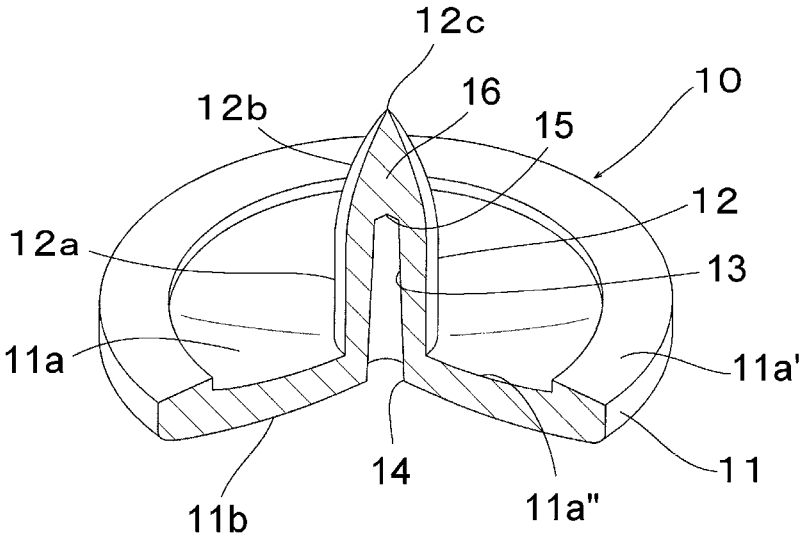
FIG. 1 is a partially cutaway perspective view showing a button fixing member in accordance with an embodiment of the present invention.
Figure 2:
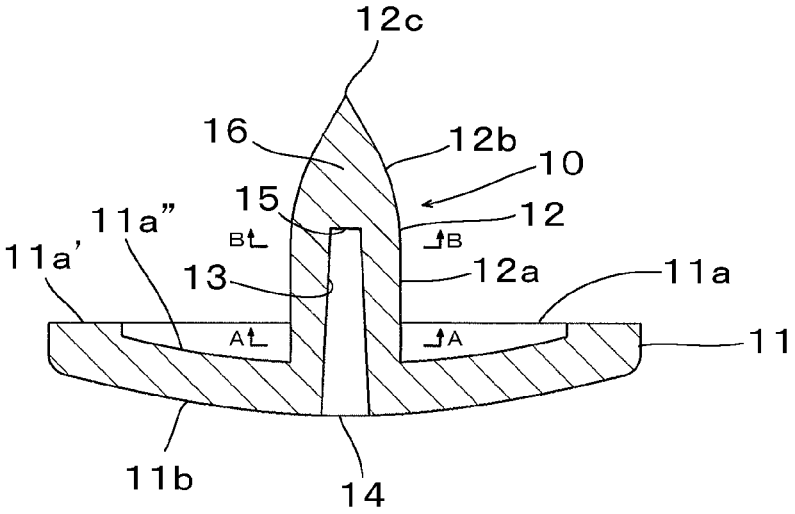
FIG. 2 is a longitudinal cross-sectional view of the button fixing member.

Hereinafter, preferable embodiments of the present invention will be described with reference to the drawings. FIG. 1 is a partially cutaway perspective view showing a button fixing member 10 in accordance with an embodiment of the present invention. FIG. 2 is a longitudinal cross-sectional view of the button fixing member 10. The button fixing member 10 is a molded product made of a synthetic resin and comprises a disk-like base 11 and a post 12 protruding upwardly (up and down are based on FIG. 2) from the base 11 concentrically therewith and having a circular, horizontal cross section. The base 11 includes a front surface 11*a* facing upwardly and a rear surface 11*b* facing downwardly. The rear surface 11*b* is a curved surface as being slightly convex downwardly. The front surface 11*a* includes an annular front outer surface 11*a*' along a horizontal plane (hereinafter also referred to as merely "horizontal") perpendicular to the axis of the post 12, and a front inner surface 11*a*" which is curved substantially parallel to the rear surface 11*b* radially inward from the front outer surface 11*a*'. The post 12 has a post proximal part 12*a* rising from the front inner surface 11*a*" of the base 11, the outer diameter of the post proximal part 12*a* being substantially constant, and a post distal part 12*b* gradually tapering upwardly from the upper end of the post proximal part 12*a* while reducing the outer diameter. The tip 12*c* of the post distal part 12*b* (namely, the tip of the post 12) is sharp so as to easily pierce a cloth 1 (see FIG. 4 etc.). The ratio of the post proximal part 12*a* and the post distal part 12*b* in length is approximately 2:1. In this case, the axial length of the post proximal part 12*a* is equal to the height from the front inner surface 11*a*" of the base 11 (the lowest point adjacent to the post proximal part 12*a* in the front inner surface 11*a*") to the upper end of the post proximal part 12*a*.

Figure 3:
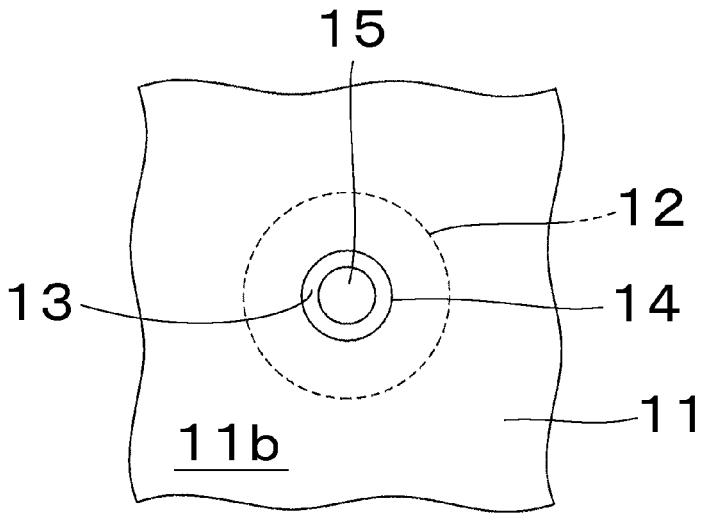
FIG. 3 is a partial bottom view of the button fixing member.
Figure 4:
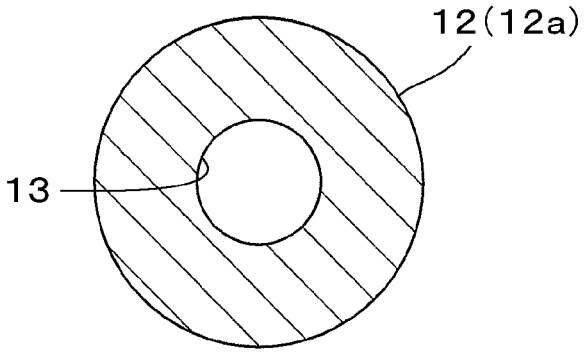
FIG. 4 is a horizontal cross-sectional view taken along the A-A line in FIG. 2.
Figure 5:
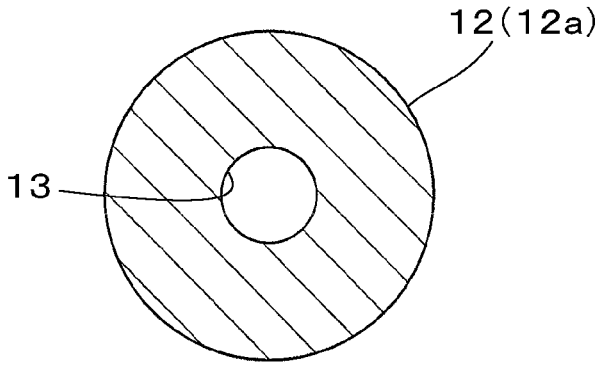
FIG. 5 is a horizontal cross-sectional view taken along the B-B line in FIG. 2.

The post 12 includes a cavity 13 therein. The cavity 13 is a space extending in the axial direction (the up-and-down direction) concentrically with the post 12, the cavity 13 having a circular, horizontal cross section. The bottom of the cavity 13 is open on the rear surface 11*b* of the base 11 as a circular bottom opening 14 and extends axially and upwardly in the post proximal part 12*a* through the base 11. The upper end of the cavity 13 is closed at a level in the axial direction slightly exceeding the upper end of the post proximal part 12*a* (or the lower end of the post distal part 12*b*). The upper end of the cavity 13 is formed as a circular closed upper end face (hereinafter also referred to as "cavity top face") 15 along the horizontal plane. The diameter of the cavity 13 is gradually reduced from the bottom opening 14 to the cavity top face 15. FIG. 3 is a partial bottom view of the button fixing member 10. In FIG. 3, the bottom opening 14 appearing on the rear surface 11*b* of the base 11 and the cavity top face 15 inside the bottom opening 14 can be seen. The post 12 is sectioned in the axial direction into a cavity portion where the cavity 13 exists and a solid portion 16 where the cavity 13 does not exist. In this embodiment, although the cavity 13 exists in the entire region in the axial direction of the post proximal part 12*a*, the cavity 13 does not almost exist (or, slightly exists) in the post distal part 12*b*. The axial length of the solid portion 16 is approximately ⅓ of the axial length of the post 12 (the length from the front inner surface 11*a*" of the base 11 to the tip 12*c*). FIGS. 4 and 5 are horizontal cross-sectional views taken along the A-A line and the B-B line, respectively, in FIG. 2. As mentioned above, the diameter of the cavity 13 is gradually reduced upwardly. Thus, in FIGS. 4 and 5, with respect to the post proximal part 12*a* having the constant outer diameter, the diameter of the cavity 13 is smaller in FIG. 5 as located at a higher position in the post proximal part 12*a*, than that in FIG. 4. The ratio between the diameter of the post 12 and that of the cavity 13 is approximately 3:1 even in any axial position including the cross sections of FIGS. 4 and 5.

Figure 6:
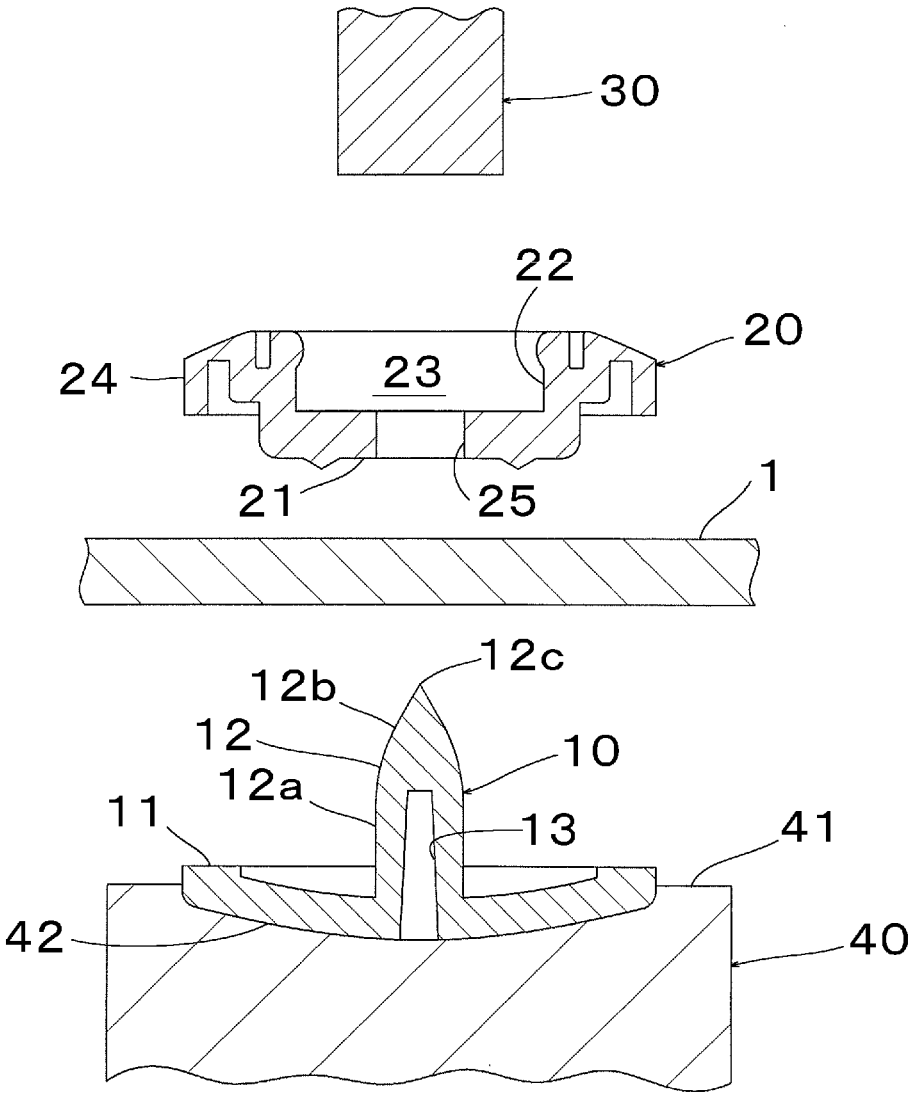
FIG. 6 is an explanatory cross-sectional view schematically showing a state where a punch, a female snap, a cloth, the button fixing member, and a lower die, etc. are arranged when the female snap is fixed to the cloth using the button fixing member.

FIG. 6 is an explanatory cross-sectional view schematically showing a state where a female snap 20 as an example of a button, the cloth 1, the button fixing member 10, a punch 30 and a lower die 40 are arranged in the up-and-down direction when the female snap 20 is fixed to the cloth 1 using the button fixing member 10. The punch 30 and the lower die 40 are used in the fixing process. The punch 30 is a part of an upper die as omitted in the Fig., and the upper die includes a button holder for holding the female snap 20 when it is fixed to the cloth 1. The female snap 20 is a molded product made of a synthetic resin and includes a circular plate-like bottom 21, an annular side 22 extending upwardly from the radially outer end of the bottom 21, a projection-receiving space 23 which detachably receives an engagement projection of a male snap (see an engagement projection 51 of a male snap 50 in FIG. 9), the projection-receiving space 23 being defined above the bottom 21 and radially inside the side 22, and a flange 24 extending radially outward from the side 22. On a center area of the bottom 21, a fixing opening 25 is formed for passing the post 12 of the button fixing member 10. The lower die 40 has on its top surface 41 a dent 42 conforming to the base 11 of the button fixing member 10. The button fixing member 10 is set on the dent 42 of the lower die 40, below the horizontally placed cloth 1.

Figure 7:
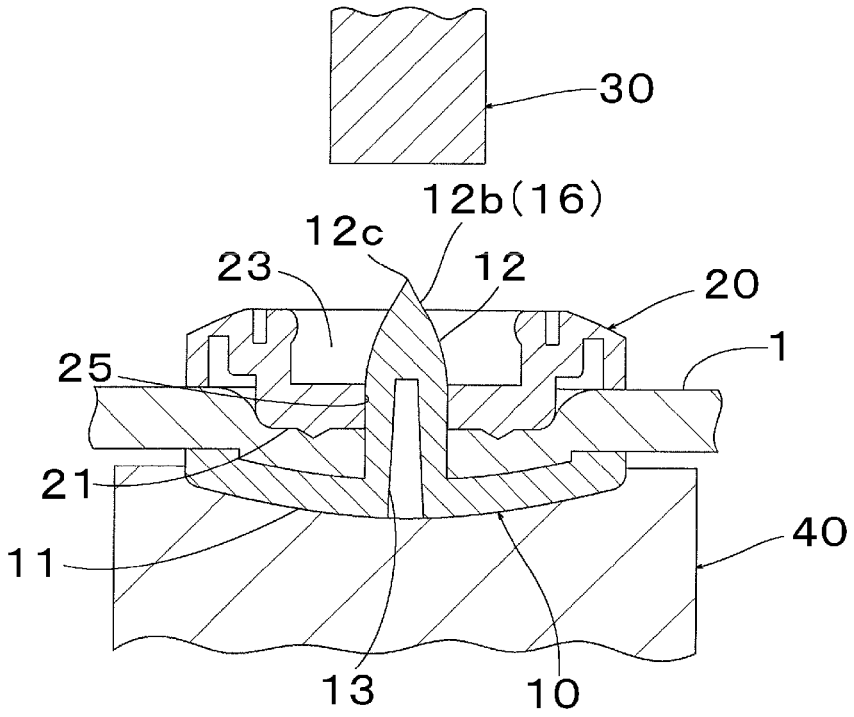
FIG. 7 is an explanatory cross-sectional view schematically showing a state where the post of the button fixing member has pierced the cloth and then passed through a fixing opening of the female snap.
Figure 8:
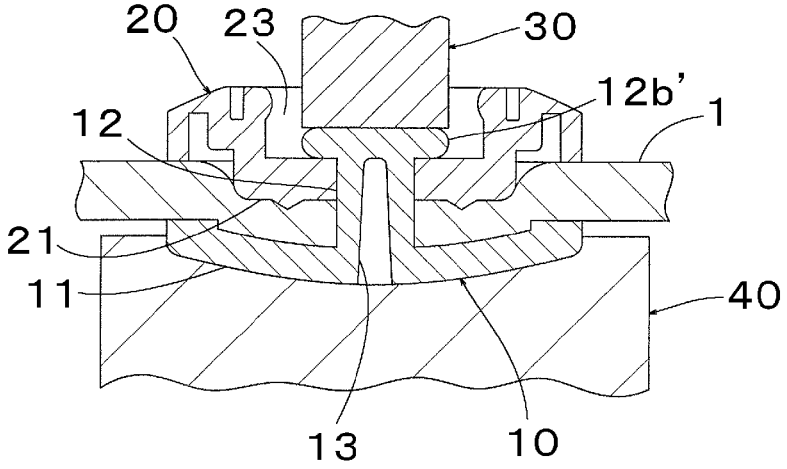
FIG. 8 is an explanatory cross-sectional view schematically showing a state where the post of the button fixing member has been swaged by the punch.

When the upper die (not shown) is lowered from the FIG. 6 state, as shown in FIG. 7, the post 12 of the button fixing member 10 pierces the cloth 1 upwardly and then passes through the fixing opening 25 of the female snap 20, protruding above the bottom 21 of the female snap 20. From this state, by lowering the punch 30, as shown in FIG. 8, the post distal part 12*b* or the solid portion 16 of the post 12 is swaged to be axially crushed by the punch 30 against the bottom 21 of the female snap 20 and to be radially expanded. The post distal part after being deformed is represented by the reference numeral 12*b*'. As a result, the female snap 20 is fixed to the cloth 1.

Figure 9:
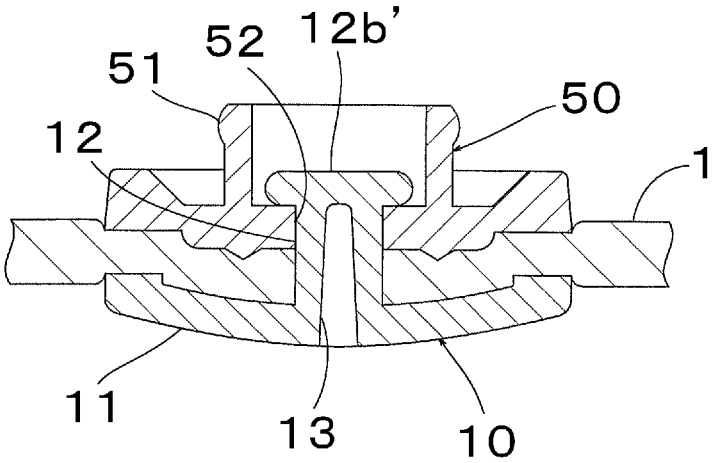
FIG. 9 is an explanatory cross-sectional view similar to FIG. 8, showing a state where a male snap as another example of a button is fixed to the cloth with the button fixing member.

In the above embodiment, the female snap 20 is cited as an example of a button to be fixed to the cloth 1 using the button fixing member 10, but it is not limited thereto. It is possible to fix a male snap 50 with the button fixing member 10 to the cloth 1 as shown in FIG. 9, in which the reference numerals 51, 52 indicates an engagement projection and a fixing opening of the male snap 50, respectively.

Figure 10:
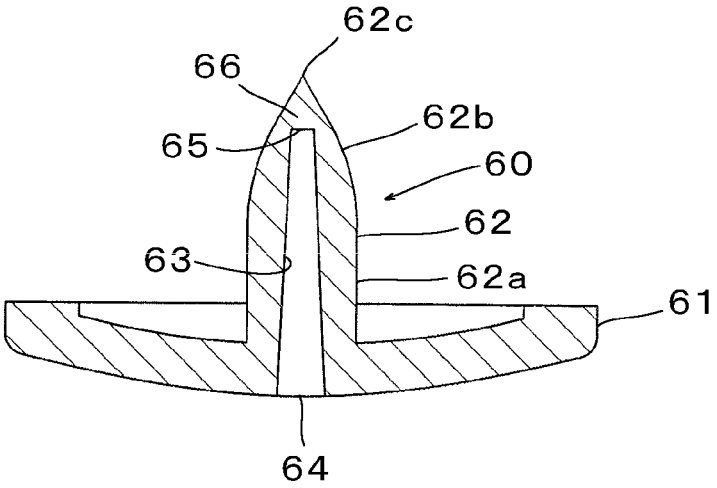
FIG. 10 is an explanatory longitudinal cross-sectional view of a button fixing member in accordance with another embodiment of the present invention.

FIG. 10 is an explanatory longitudinal cross-sectional view of a button fixing member 60 in accordance with another embodiment of the present invention. The button fixing member 60 has the same shape as with the button fixing member 10 except for a cavity 63 and includes a disk-like base 61 and a post 62 protruding from the base 61. Also, the post 62 has a post proximal part 62*a*, the outer diameter of which is substantially constant and a post distal part 62*b*, the outer diameter of which is gradually reduced from the upper end of the post proximal part 62*a* to the tip 62*c*. The cavity 63 axially extends upwardly in the post proximal part 62*a* from the rear surface of the base 61 through the base 61, exceeding the upper end level of the post proximal part 62*a* and reaching a level of approximately ⅔ of the axial length of the post distal part 62*b*. The diameter of the cavity 63 is gradually reduced from a bottom opening 64 to an upper end face 65. In this embodiment, the axial length of the cavity 63 is ⅘ of the axial length of the post 62 (or the height of the post 62 from the front surface of the base 61). The axial length of a solid portion 66 where the cavity 63 does not exist is ⅕ of the axial length of the post 62.

Figure 11:
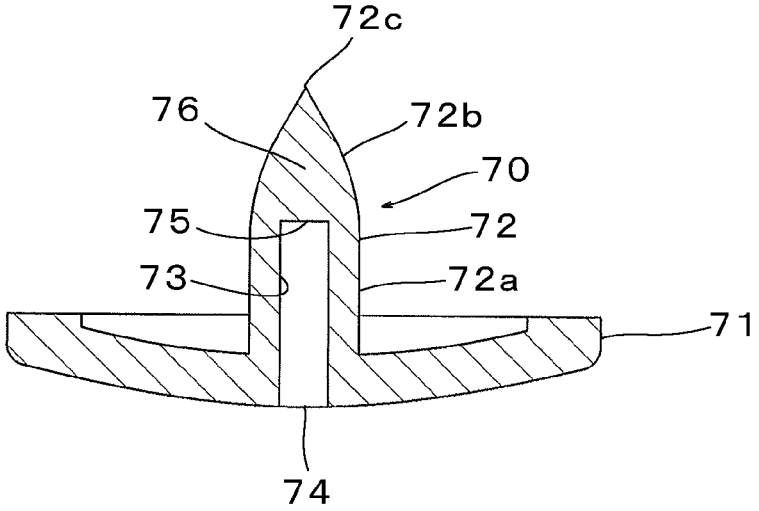
FIG. 11 is an explanatory longitudinal cross-sectional view of a button fixing member in accordance with still another embodiment of the present invention.

FIG. 11 is an explanatory longitudinal cross-sectional view of a button fixing member 70 in accordance with still another embodiment of the present invention. The button fixing member 70 has the same shape as with the button fixing member 10 except for a cavity 73 and includes a disk-like base 71 and a post 72 protruding from the base 71. The post 72 includes a post proximal part 72*a*, the outer diameter of which is substantially constant and a post distal part 72*b*, the outer diameter of which is reduced gradually from the upper end of the post proximal part 72*a* to the tip 72*c*. The cavity 73 extends from a bottom opening 74 to an upper end face 75 at the upper end level of the post proximal part 72*a*, and has a constant diameter. Thus, the ratio between the axial length of the cavity 73 and that of a solid portion 76 is approximately 2:1 similar to the button fixing member 10.

Figure 12:
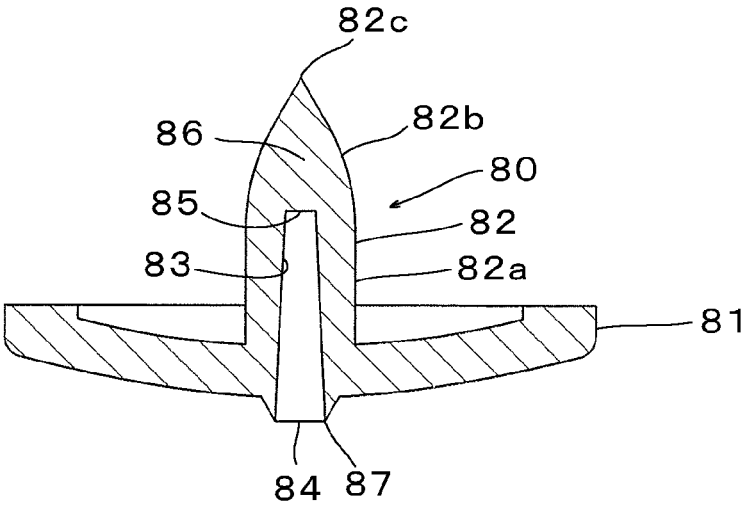
FIG. 12 is an explanatory longitudinal cross-sectional view of a button fixing member in accordance with still another embodiment of the present invention.

FIG. 12 is an explanatory longitudinal cross-sectional view of a button fixing member 80 in accordance with still another embodiment of the present invention. The button fixing member 80 has an annular bulge 87 bulging downwardly around a bottom opening 84 of a cavity 83 on the rear surface of a base 81. The button fixing member 80 has the substantially same shape as with the button fixing member 10 except for the annular bulge 87 provided. The post 82 includes a post proximal part 82*a*, the outer diameter of which is substantially constant and a post distal part 82*b*, the outer diameter of which is reduced gradually from the upper end of the post proximal part 82*a* to the tip 82*c*. In FIG. 12, the reference numeral 85 indicates an upper end face of the cavity 83, and the reference numeral 86 indicates a solid portion. As described below, the annular bulge 87 is intended to close the bottom opening 84 when the button fixing member 80 is used to fix the female snap 20 to the cloth 1 (as to the female snap 20 and the cloth 1, the same reference numerals as those in FIG. 6 etc. are assigned because they are identical).

Figure 13:
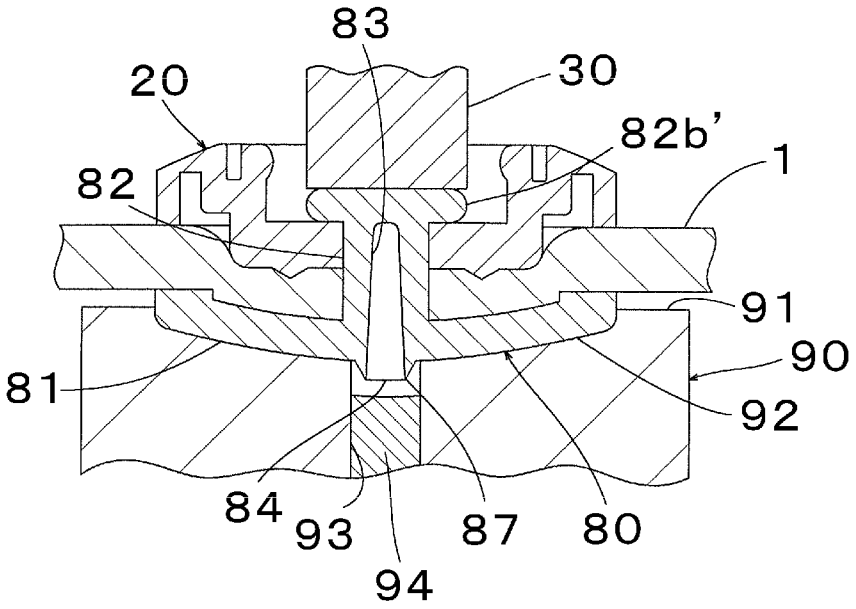
FIG. 13 is an explanatory cross-sectional view schematically showing a state where a post distal part of the button fixing member shown in FIG. 12 has been swaged by the punch as the female snap is fixed to the cloth with the button fixing member.
Figure 14:
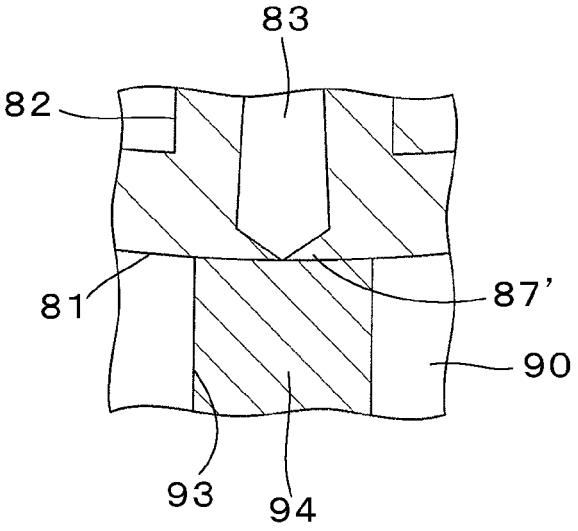
FIG. 14 is an explanatory partial cross-sectional view schematically showing a state where a bottom opening of the button fixing member shown in FIG. 12 has been closed using a lower punch.

FIG. 13 shows a state where the post distal part 82*b* of the button fixing member 80 is swaged as described above by the punch 30 (the same reference numeral as the punch in FIG. 8 etc. is assigned because they are identical) as the female snap 20 is fixed to the cloth 1, the button fixing member 80 being set in a dent 92 on the top surface 91 of a lower die 90. The lower die 90, which has a cylindrical shape, includes a central path 93 extending along its axis and a lower punch 94 which can be moved up and down through the central path 93. Simultaneously with or immediately after the punch 30 swaging the post distal part 82*b*, the lower punch 94 is moved up to crush the annular bulge 87 so that the bulge becomes substantially flush with the rear surface of the base 81 (see FIG. 14). In FIG. 14, the annular bulge after being deformed is represented by the reference numeral 87'. Thereby, the bottom opening 84 of the cavity 83 is closed.

In the above-described button fixing member 10, 60, 70, 80, because of the cavity 13, 63, 73, 83, the thickness of the post 12, 62, 72, 82 can be reduced. Thereby, even if the button fixing member 10, 60, 70, 80 is injection-molded, almost no void arises in the post 12, 62, 72, 82. Further, because of the solid portion 16, 66, 76, 86 of the post 12, 62, 72, 82, a quantity of material needed at swaging can be secured.

DESCRIPTION OF REFERENCE NUMBERS

1 cloth
10, 60, 70, 80 button fixing member
12, 62, 72, 82 post
12*a*, 62*a*, 72*a*, 82*a* post proximal part
12*b*, 62*b*, 72*b*, 82*b* post distal part
12*c*, 62*c*, 72*c*, 82*c* tip
13, 63, 73, 83 cavity
14, 64, 74, 84 bottom opening (of cavity)
15, 65, 75, 85 upper end face
16, 66, 76, 86 solid portion
20 female snap
25, 52 fixing opening
50 male snap
87 annular bulge

The invention claimed is:

1. A button fixing member made of a synthetic resin, which is used to fix a button having a fixing opening to a cloth, the button fixing member comprising:

a plate-like base and a post protruding from the base to a front surface side of the base, the post capable of being deformed after it passes through the cloth and then the fixing opening of the button when the button is fixed to the cloth, wherein the post includes a cavity extending from an opening on a rear surface of the base to a closed end on a tip-side of the post concentrically with the post, and a solid portion between the closed end of the cavity and a tip of the post, wherein a diameter of the cavity is gradually reduced from the opening to the closed end, wherein the post includes a post proximal part rising from the base, an outer diameter of the post proximal part being constant, and a post distal part, an outer diameter of which is gradually reduced from an upper end of the post proximal part to the tip, the post proximal part including the cavity.

2. The button fixing member according to claim 1, wherein a length of the solid portion in a longitudinal direction of the post is ⅕ or more of a length of a part of the post from a front surface of the base to the tip of the post.

3. The button fixing member according to claim 1, wherein around the opening on the rear surface of the base, there is an annular bulge, which is capable of closing the opening as the button is fixed to the cloth.

4. A button structure which consists of a button having a fixing opening and a button fixing member made of a synthetic resin, which is used to fix the button to a cloth, the button fixing member comprising:

a plate-like base and a post protruding from the base to a front surface side of the base, the post capable of being deformed after it passes through the cloth and then the fixing opening of the button when the button is fixed to the cloth, wherein the post includes a cavity extending from an opening on a rear surface of the base to a closed end on a tip-side of the post concentrically with the post, and a solid portion between the closed end of the cavity and a tip of the post, wherein a diameter of the cavity is gradually reduced from the opening to the closed end, wherein the post includes a post proximal part rising from the base, an outer diameter of the post proximal part being constant, and a post distal part, an outer diameter of which is gradually reduced from an upper end of the post proximal part to the tip, the post proximal part including the cavity.

5. The button fixing member according to claim 2, wherein around the opening on the rear surface of the base, there is an annular bulge, which is capable of closing the opening as the button is fixed to the cloth.

* * * * *